United States Patent [19]

Geis

[11] 4,105,106

[45] Aug. 8, 1978

[54] TYPEWRITER PLATEN CLUTCH MECHANISM

[75] Inventor: Heinz Geis, Frankfurt am Main, Fed. Rep. of Germany

[73] Assignee: Adlerwerke vorm. Heinrich Kleyer A.G., Nuremberg, Fed. Rep. of Germany

[21] Appl. No.: 763,007

[22] Filed: Jan. 27, 1977

Related U.S. Application Data

[63] Continuation of Ser. No. 552,105, Jul. 24, 1975, abandoned.

[30] Foreign Application Priority Data

Jun. 15, 1974 [DE] Fed. Rep. of Germany ..... 2428944

[51] Int. Cl.[2] ..... B41J 19/80

[52] U.S. Cl. ..... 400/556.2; 192/67 P

[58] Field of Search ..... 197/123; 192/65, 67 P, 192/67 R, 111 R, 111 A; 64/27 R, 27 B; 74/409

[56] References Cited

U.S. PATENT DOCUMENTS

| | | | |
|---|---|---|---|
| 1,118,140 | 11/1914 | Lockwood | 197/123 |
| 1,673,959 | 6/1928 | Wallgren | 64/15 B |
| 2,554,754 | 5/1951 | Priezioso | 197/123 |
| 2,555,521 | 6/1951 | Veltman et al. | 197/123 |
| 2,619,211 | 11/1952 | Belden | 192/67 R |
| 2,819,781 | 1/1958 | Davidson | 197/127 |
| 2,841,000 | 7/1958 | Parks et al. | 64/27 B |
| 3,035,454 | 5/1962 | Luning | 74/409 |
| 3,167,164 | 1/1965 | Bland et al. | 192/70.27 |
| 3,365,723 | 1/1968 | Spormann | 197/123 |
| 3,385,407 | 5/1968 | Kleinhaus et al. | 192/53 B |
| 3,847,261 | 11/1974 | Matsuhisa | 197/123 |

FOREIGN PATENT DOCUMENTS

| | | | |
|---|---|---|---|
| 1,131,706 | 6/1962 | Fed. Rep. of Germany | 197/123 |

*Primary Examiner*—Russell R. Kinsey
*Assistant Examiner*—Paul J. Hirsch
*Attorney, Agent, or Firm*—Joseph R. Spalla

[57] ABSTRACT

A normally engaged toothed cone clutch mechanism to allow disengagement of the platen of a typwriter from a line indexing ratchet wheel to enable rotation of the platen independently of the ratchet wheel includes a clutch member and a connection between the clutch member and the ratchet wheel. The connection takes the form of a spring washer secured to the clutch member and pins extending axially from the ratchet wheel toward the clutch member. The spring washer is formed to embrace and grip the pins to transmit rotary motion of the ratchet wheel to the clutch member without play yet allow axial sliding movement of the clutch member to disengaged position while maintaining its connection to the ratchet wheel.

4 Claims, 2 Drawing Figures

Fig_1
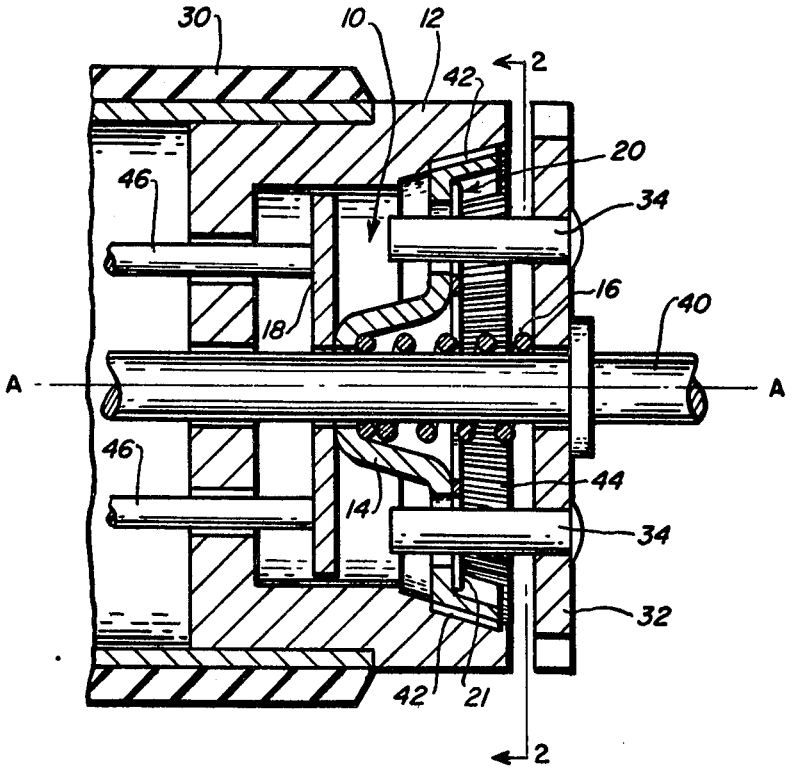
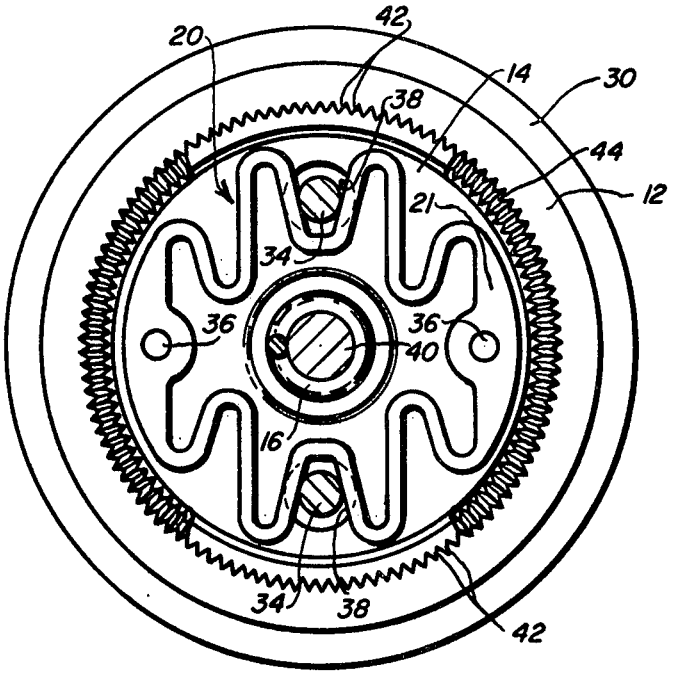
Fig_2

TYPEWRITER PLATEN CLUTCH MECHANISM

This is a continuation, of application Ser. No. 552,105 filed Feb. 24, 1975, now abandoned.

BACKGROUND OF THE INVENTION

This invention relates to an electric typewriter or similar machine and more particularly to a clutch mechanism for use with a platen for such machines which will selectively permit the platen to be vertically indexed either automatically line-by-line or manually in a free-wheel, vernier fashion.

Electric typewriters or similar machines generally have a platen fixed to a central shaft supported for rotation in a frame member. The page which is being typed is pressed into frictional engagement with the platen and as the platen is rotated, the page is vertically advanced to present a fresh surface for typing. During normal typing, the platen is advanced line-by-line with a predetermined spacing between each line. This is generally done by actuating a pawl which is in engagement with a line indexing ratchet wheel which is in turn connected through a clutch to and is concentric with the platen. Each time it is desired to type a fresh line, the pawl is actuated to rotate the line indexing ratchet wheel predetermined distance, which then rotates the platen a predetermined distance. Thus, the page is advanced to present a fresh line.

The clutch between the line indexing wheel and the platen is provided so that the platen may be rotated independently of the ratchet wheel when the clutch is disengaged. Clutches for disengaging the platen from the line indexing ratchet wheel as known in the art comprise mating gears on the platen and a clutch member which is connected to the ratchet wheel. To disengage the platen and ratchet wheel, the clutch member is axially moved out of meshing engagement with the platen gear and relative to the line indexing ratchet wheel. To avoid play in the connection between the line indexing ratchet wheel and the clutch element, yet allow relative movement therebetween, has not been adequately solved in a simple manner by the prior art, one example of which is German Provisional Pat. No. 2,242,074 which accommodates play by adjusting the radial spacing of the clutch member gear teeth relative to the platen gear teeth.

SUMMARY OF THE INVENTION

Briefly, the invention comprises a normally engaged toothed cone clutch between a platen and a line indexing ratchet wheel and an angular motion transmitting connection between the ratchet wheel and a rigid clutch member which is axially movable relative to the ratchet wheel to disengage the clutch. The connection between the clutch member and ratchet wheel is continuously maintained and avoids all rotary play, yet allows axial movement of the clutch member to disengaged position. The connection takes the form of a resilient motion transmitting spring washer rigidly connected to the clutch member, and having notched openings for the receipt of pins rigidly connected to the line indexing ratchet wheel. When the clutch member is disengaged from the platen, the spring washer slides on the pins connected to the line indexing ratchet wheel with relatively little applied force while maintaining positive rotary engagement therewith, thereby disengaging the teeth on the clutch member from the teeth associated with the platen. When the clutch member is returned to its position engaging the platen, the spring washer slides back on the pins, and the gear teeth associated with the platen are forced to mesh with and fully contact the gear teeth of the clutch member. The gripping action of the spring washer on the pins of the line indexing ratchet wheel provides a play-free rotary motion transmitting connection between the line indexing means and the clutch member.

OBJECTS OF THE INVENTION

An object of the invention is to eliminate rotary play or slack between the line indexing ratchet wheel and the platen of a typewriter.

Yet another object of the invention is to provide a motion transmitting connection between a line indexing ratchet wheel and a clutch element movable axially relative thereto which avoids rotary play between the line indexing ratchet wheel and the clutch element.

Other objects and many of the attendant advantages of this invention will be readily appreciated as the same becomes better understood by reference to the following detailed description when considered in connection with the accompanying drawing.

BRIEF DESCRIPTION OF THE DRAWING

FIG. 1 is a cross-sectional view of a portion of a platen, showing the clutch mechanism and line indexing gear; and FIG. 2 is a view along lines 2—2 of FIG. 1 showing in particular the torque transmitting member of the clutch mechanism, in the form of a spring washer.

DETAILED DESCRIPTION OF THE INVENTION

Referring now to the drawing wherein like reference characters designate like or corresponding parts throughout the several view there is shown in FIG. 1, a clutch mechanism generally designated by reference numeral 10 disposed between a platen 30 which is secured in conventional manner to a central shaft 40 and a line indexing ratchet wheel 32 rotatably mounted on shaft 40. A guide 12, fixed to platen 30, forms the end of the platen.

Clutch mechanism 10 which is disposed comprises an axially movable clutch member 14, spring 16 for engaging clutch member 14 rotatably mounted on shaft 40 with guide 12, plate 18 for disengaging clutch member 14 from guide 12, and motion transmitting means 20 for transmitting the angular displacement of line indexing ratchet wheel 32 via the clutch mechanism to platen 30.

Pins 34 are rigidly fixed to line indexing gear 32, and are of sufficient length to extend through motion transmitting means 20 and clutch member 14. Motion transmitting means 20, as more clearly illustrated in FIG. 2, is in the form of a resilient spring washer 21 which is rigidly fastened to clutch member 14, as by rivets 36. Spring washer 21 may be stamped from sheet metal, making the washer relatively inexpensive and easy to manufacture. Spring washer 21 is provided with a plurality of V-shaped notches 38 for the receipt of pins 34 thereby to resiliently grip the pins 34 yet allow axial movement of the spring washer and connected clutch member relative to pins 34.

A plurality of teeth 42 are disposed on the outer periphery of 180° spaced conical segments of clutch member 14. A second set of teeth 44 are disposed on an interior conical surface of guide 12, with teeth 42 of clutch member 14. Spring 16 is disposed between line indexing ratchet wheel 32 and clutch member 14 on shaft 40, urging the teeth 42 of clutch member 14 into engagement with the teeth 44 of guide 12 thereby accurately positioning the platen relative to the line indexing ratchet with the conical configuration accommodating tooth wear.

During normal typing, in order to index a sheet of paper to type a fresh line, a pawl (not shown) is actuated by conventional apparatus to rotate line indexing ratchet wheel 32 and pins 34 a predetermined distance about axis A—A. As pins 34 rotate, they act against the V-shaped notches 38 of spring washer 21, thus rotating spring washer 21 and clutch member 14. As clutch member 14 rotates, teeth 42 of clutch member 14, in meshing engagement with teeth 44 of guide 12, rotate guide 12 and platen 30. Thus, spring washer 21 transmits the angular displacement from line indexing ratchet wheel 32 to platen 30.

When it is desired to manually rotate the platen to vary the predetermined line spacing it is necessary to disengage the platen 30 from the line indexing ratchet wheel 32. To disengage the platen, a plurality of pins 46 are provided. Pins 46 are connected to a flat plate 18 which is disposed on shaft 40 on the side of clutch member 14 opposite spring 16. When force is applied to pins 46 to move them to the right as viewed in FIG. 1, plate 18 moves to the right, pushing clutch member 14 and spring washer 21 to the right, against the force of spring 16. As spring washer 21 moves to the right, the V-shaped notches 38 formed in the spring washer maintain position gripping engagement with pins 34. As clutch member 14 moves to the right, teeth 42 of the clutch member 14 disengage from teeth 44 of guide 12. Force may be applied to pins 46 by any appropriate manual or automatic means, but pins 46 are generally forced to the right by manually depressing an end cap (not shown) to which the pins 46 are attached. Platen 30 is thus disengaged from line indexing ratchet wheel 32, and platen 30 can be rotated about axis A—A by rotating end knobs (not shown) on shaft 40, platen 18 thus rotates relative to clutch member 14 and line indexing gear 32, which are fixed by a detent mechanism (not shown).

When force is removed from pins 46, spring 16 returns clutch member 14, spring washer 21 and plate 18 to the position illustrated in FIG. 1. As the clutch member returns from the disengaged position to the engaged position the V-shaped notches 38 of the spring washer 21 maintain resilient gripping engagement with pins 34, while allowing axial movement relative thereto. When clutch member 14 is returned to the engaged position, teeth 42 of the clutch member will be urged into full engagement with teeth 44 of guide 12. As teeth 42 mesh with teeth 44, under the action of spring 16, the platen will be accurately position relative to the index wheel.

Thus, a connection between the ratchet wheel and clutch has been described which allows the platen of a typewriter to be selectively indexed line-by-line or in a freewheel, vernier fashion which eliminates rotary play between the ratchet wheel and and clutch mechanism incident to clutch engagement and reengagement.

I claim:

1. In a typewriter having a platen fixedly supported on a center shaft and line indexing wheel rotatably supported on one end of said shaft, and means releasably coupling said indexing wheel to said platen for selective machine controlled or manual indexing of said platen, said coupling means comprising a first gear rotatably supported on and axially movable relative to said shaft, a second gear fixed to said platen and a spring normally axially urging said first gear into meshing engagement with said second gear, a circular rotary motion transmitting spring secured to said first gear having radially directed notches, and pins extending axially from said indexing wheel into said notches, said notches gripping said pins whereby rotary motion of said indexing wheel is transmitted through said spring to drive said first gear, said notches further facilitating axial disengaging movement of said first gear from engagement with said second gear guided by said pins to allow said platen to be rotated independently of said line indexing wheel.

2. In a typewriter having a platen and a platen indexing ratchet wheel rotatably mounted on a central shaft, a normally engaged clutch coupling said platen and ratchet wheel, said clutch including a single piece clutch member supported on said shaft for rotary and axial movement relative thereto and a spring normally axially urging said clutch member in a direction to engage said clutch, and means coupling said clutch member and said ratchet wheel to allow substantially frictionless relative axial movement between said clutch member and said ratchet wheel in a clutch disengage direction while maintaining a resilient play-free rotary motion transmitting connection therebetween.

3. In a typewriter as recited in claim 2, said last named means including at least one pin secured to said ratchet wheel extending axially in the direction of said clutch member, and a flat spring secured to said clutch member resiliently embracing said pin.

4. In a typewriter as recited in claim 2, said clutch being a toothed conical clutch.

* * * * *